US011401124B2

(12) United States Patent
Nir et al.

(10) Patent No.: US 11,401,124 B2
(45) Date of Patent: Aug. 2, 2022

(54) MEDIA SHEET SKEW CORRECTION

(71) Applicant: HEWLETT-PACKARD DEVELOPMENT COMPANY, L.P., Spring, TX (US)

(72) Inventors: Jonathan Nir, Ness Ziona (IL); Hagay Shkalim, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/605,513

(22) PCT Filed: Jul. 25, 2018

(86) PCT No.: PCT/US2018/043694
§ 371 (c)(1),
(2) Date: Oct. 16, 2019

(87) PCT Pub. No.: WO2020/023030
PCT Pub. Date: Jan. 30, 2020

(65) Prior Publication Data
US 2021/0354942 A1 Nov. 18, 2021

(51) Int. Cl.
*B65H 7/08* (2006.01)
*B41J 13/32* (2006.01)
*B65H 9/00* (2006.01)

(52) U.S. Cl.
CPC ..... *B65H 7/08* (2013.01); *B41J 13/32* (2013.01); *B65H 9/004* (2013.01); *B65H 2301/331* (2013.01); *B65H 2511/242* (2013.01); *B65H 2513/41* (2013.01); *B65H 2513/53* (2013.01)

(58) Field of Classification Search
CPC ... B65H 7/00; B65H 7/02; B65H 7/08; B65H 7/14; B65H 7/20; B65H 9/00; B65H 9/002; B65H 9/004; B65H 9/14; B65H 2301/331; B65H 2511/242; B41J 13/32
See application file for complete search history.

(56) References Cited

U.S. PATENT DOCUMENTS 7,445,208 B2 * 11/2008 Onodera ..... B65H 9/166 271/226
7,469,894 B2 12/2008 Seto
7,914,001 B2 3/2011 Herrmann
8,469,476 B2 6/2013 Mandel et al.
8,840,104 B2 9/2014 Fujikake
(Continued)

FOREIGN PATENT DOCUMENTS

EP 2407402 A2 1/2012
JP 2005272021 A * 10/2005 ..... B65H 5/062
(Continued)

*Primary Examiner* — Prasad V Gokhale
(74) *Attorney, Agent, or Firm* — HP Inc. Patent Department

(57) ABSTRACT

In an example of the disclosure, a driver correction specification is calculated based upon a time differential between a first sensor detection of a first portion of a leading edge of a media sheet and second sensor detection of a second portion of the leading edge. The driver correction specification is for causing skew correction of the media sheet as the media sheet moves along a media path to impact a blocker element. The driver is caused to operate according to the calculated driver correction specification.

14 Claims, 9 Drawing Sheets

(56) References Cited

U.S. PATENT DOCUMENTS

| | | | | |
|---|---|---|---|---|
| 2008/0022866 | A1 | 1/2008 | Frank et al. | |
| 2009/0057994 | A1* | 3/2009 | Kondo | B65H 7/02 271/228 |
| 2010/0158595 | A1 | 6/2010 | Kao | |
| 2012/0133093 | A1 | 5/2012 | Saito | |
| 2013/0056926 | A1* | 3/2013 | Deno | B65H 9/008 271/228 |
| 2016/0280488 | A1* | 9/2016 | Watanabe | B65H 9/002 |

FOREIGN PATENT DOCUMENTS

| | | | |
|---|---|---|---|
| WO | WO2017074470 | A1 | 5/2017 |
| WO | WO2017099729 | A1 | 6/2017 |

* cited by examiner

MEDIA SHEET SKEW CORRECTION

BACKGROUND

A print system may apply print agents to a paper or another media to produce an image on the media. One example of a print system is a sheet fed print system, which applies the print agents to a media sheet (a sheet of media is sometimes referred to as a "page"). In certain examples, print systems may apply to a media sheet a print agent that is an electrostatic printing fluid (e.g., electrostatically chargeable toner or resin colorant particles dispersed or suspended in a carrier fluid). Such systems are commonly referred to as sheet fed LEP print systems. In other examples, sheet fed print systems may apply print agent via inkjet (e.g., thermal inkjet or piezo inkjet) or dry toner printing technologies.

DRAWINGS

FIGS. 5A, 5B, 6A, 6B, 7A, 7B, and 7C illustrate examples of a system for media sheet skew correction.

Figure 8:
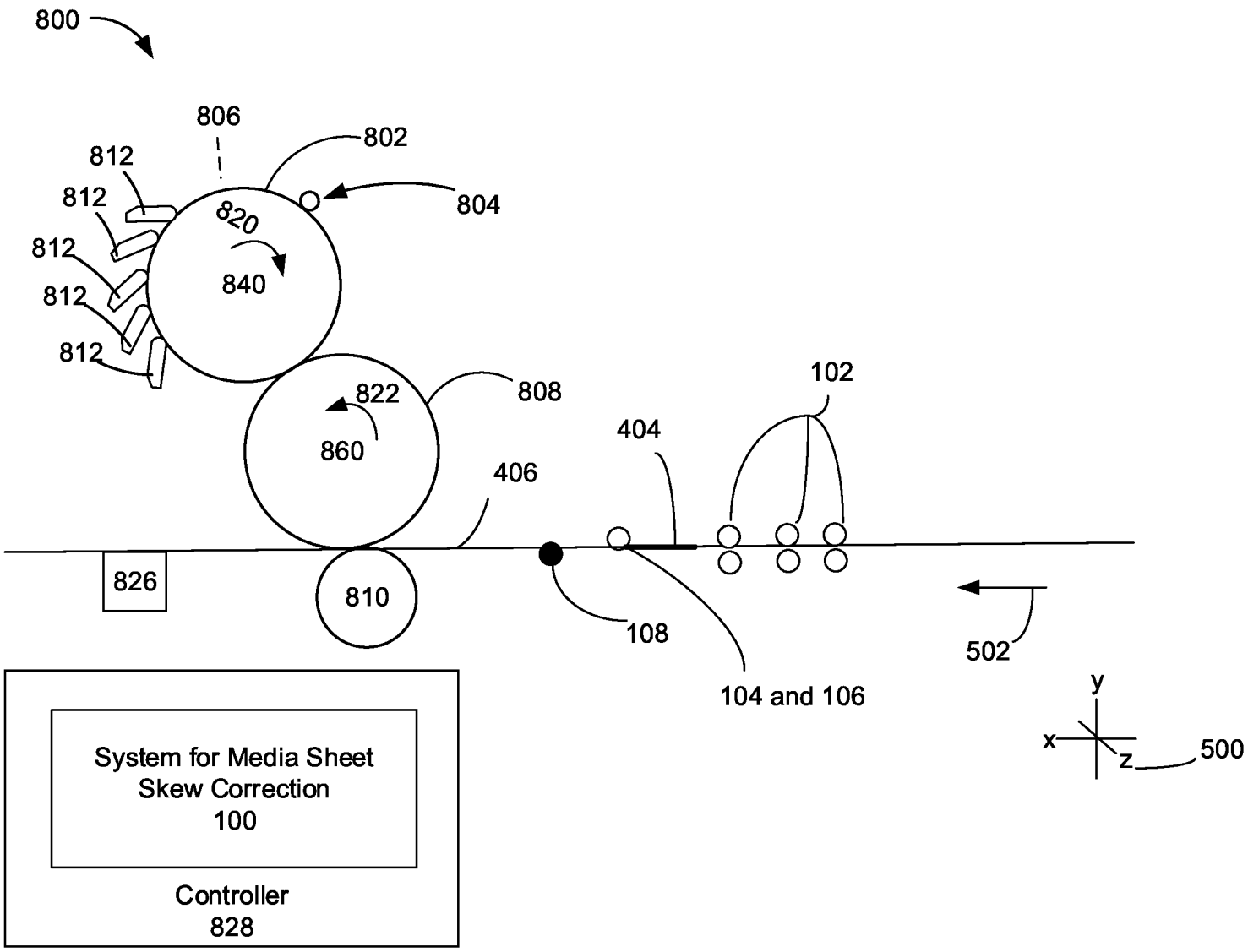

FIG. 8 is a schematic diagram showing a cross section of a LEP printer implementing a system for media sheet skew correction, according to an example of the principles described herein.

Figure 9:
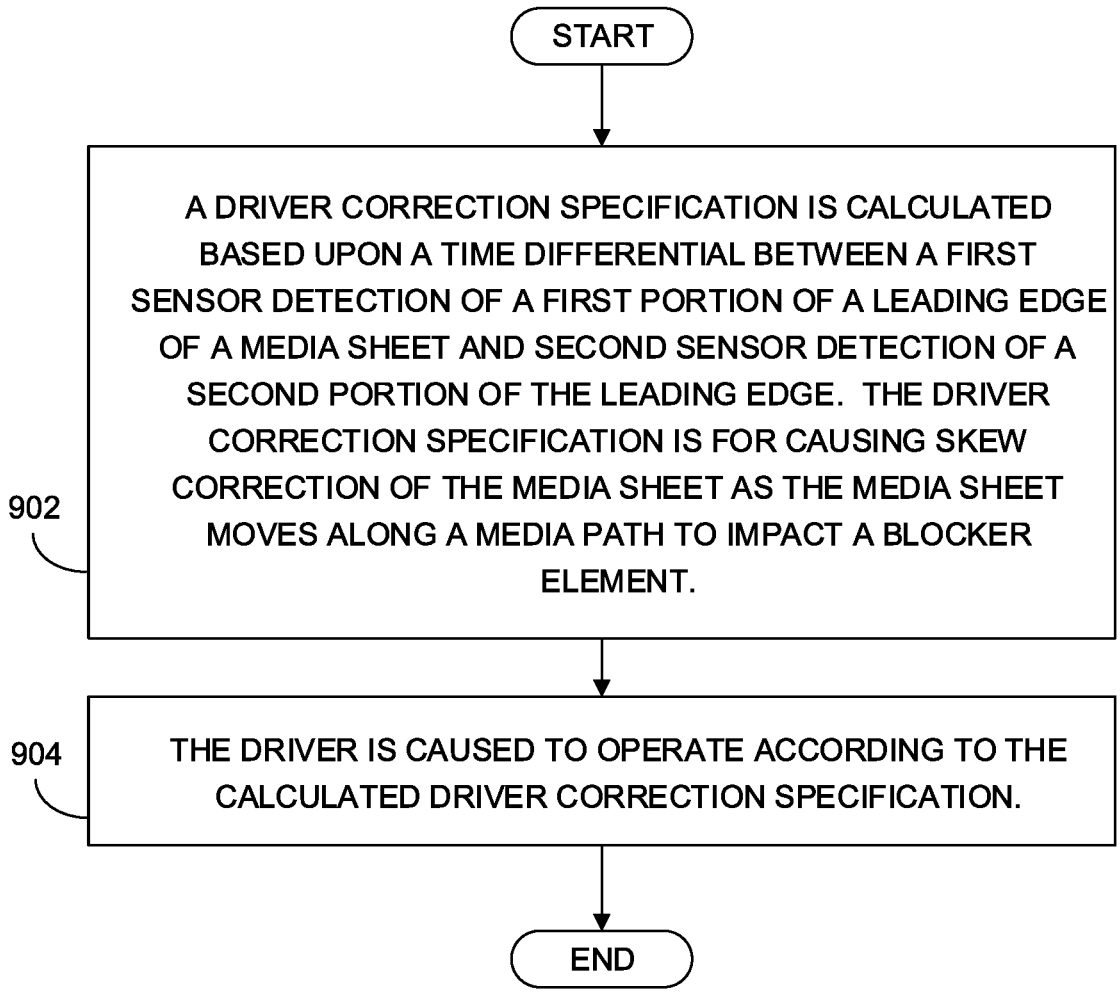

FIG. 9 is a flow diagram depicting an example implementation of a method for media sheet skew correction.

DETAILED DESCRIPTION

In sheet fed LEP printing, as in many other printing processes, it is desirable to align the print media so that the media is accurately presented to the printing unit. Any misalignment across the leading edge of a media sheet, commonly referred to as a "skew" of the media sheet, can result in registration errors and other significant print quality issues. To correct skewed sheet errors prior to the media sheet being delivered to the printing unit, certain sheet fed print systems may cause a leading edge of the media sheet to encounter an obstructive element in the media path. The resulting contact between the media sheet leading edge and the obstruction is to cause the media sheet to rotate to a proper position for the printing unit to apply print agent to the media.

However, in certain circumstances the above described skew correction process may not sufficiently correct skew of media sheet. If the print system drives the media sheet to encounter the obstructive element at a speed that is too fast or too slow for the skew situation it is attempting to resolve, the intended corrective action may be ineffective. For instance, while a media sheet encounter with an obstructive element at an incorrect speed can result in the media sheet being aligned orthogonally with the media path, such an encounter may cause a lateral shift of the media sheet relative to the media path that results in significant print quality issues. Likewise, media sheet contact with the obstructive element at too high a speed can cause the media sheet to buckle, bend, or deform. Further, a media sheet contact with the obstructive element at too low a speed can result in ineffective rotation of the media sheet such that deskewing is incomplete and/or unnecessarily slow the printing operation.

To address these issues, various examples described in more detail below provide a system and a method that enables media sheet skew correction with high efficiency and minimal strain on the media. In an example of the disclosure, a method to correct media sheet skew includes utilizing a first sensor to detect a first portion of a leading edge of a media sheet as the media sheet is transported by a driver along a media path. A second sensor is utilized to detect a second portion of the leading edge of the media sheet as the media sheet is transported by the driver along the media path. In examples, the first sensor and/or the second sensor may be optical sensors.

A correction specification for the driver is calculated. The correction specification is for causing skew correction of the media sheet as the media sheet impacts a blacker element situated orthogonal to the media path and downstream of the first sensor and the second sensor. The calculation is based upon a time differential between first sensor detection of the first portion and second sensor detection of the second portion. The driver is caused to implement the calculated correction specification. In examples, the calculation of the driver correction specification is based upon a width of the media sheet. In examples, the calculated driver correction specification includes an amount of time and speed that the driver is to be engaged to cause a leading corner of the leading edge to impact the blocker element and advance a lagging corner of the leading edge to a position such that the leading edge is horizontal with the blacker element. In certain examples, the calculated driver correction specification is a change in speed of the rollers of the driver.

In examples, a third sensor may be utilized to detect the media sheet as it is being transported at a first speed. In these examples, the third sensor may trigger implementation of the driver correction specification such that the media sheet is transported at a second speed that is less than the first speed. In certain examples the second speed is approximately 25% of the first speed.

In this manner the disclosed apparatus and method enables control of media transport speed so as to more accurately correct media sheet skew with reduced strain on media sheet. Users and providers of LEP printer systems and other printer systems will appreciate the improvements in print quality, reduced waste, and optimized media sheet transport delivery afforded by utilization of the disclosed examples. Installations and utilization of LEP printers that include the disclosed apparatus and methods should thereby be enhanced.

FIGS. 1-5 depict examples of physical and logical components for implementing various examples. In FIGS. 1-5 various components are identified as engines 110 and 112. In describing engines 110 and 112 focus is on each engine's designated function. However, the term engine, as used herein, refers generally to hardware and/or programming to perform a designated function. As is illustrated later with respect to FIG. 3, the hardware of each engine, for example, may include one or both of a processor and a memory, while the programming may be code stored on that memory and executable by the processor to perform the designated function.

Figure 1:
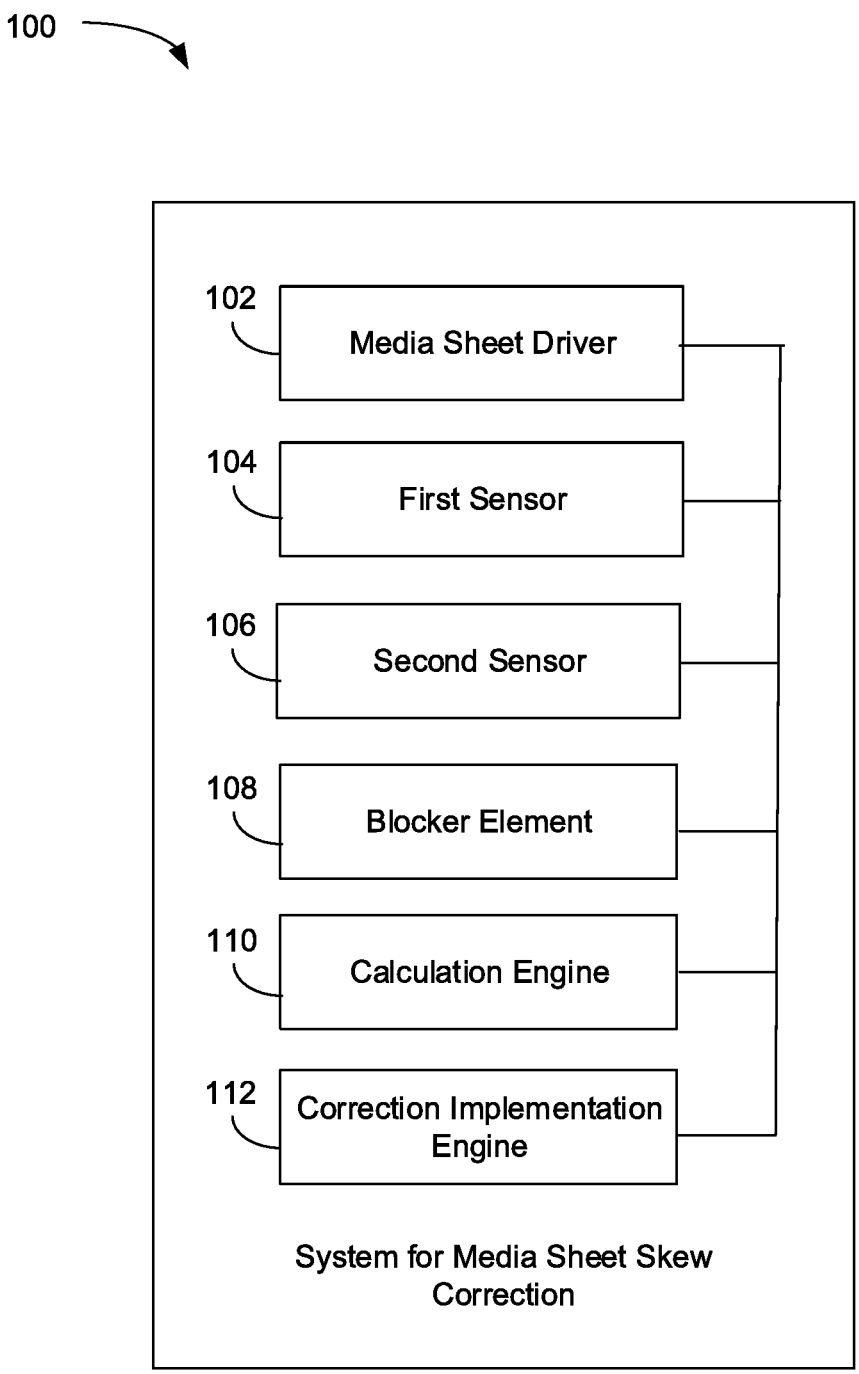
FIG. 1 illustrates an example of a system for media sheet skew correction.

FIG. 1 illustrates an example of a system 100 for media sheet skew correction. In this example, system 100 includes a media sheet driver 102, a first sensor 104, a second sensor 106, a blacker element 108, a calculation engine 110, and a correction implementation engine 112. In performing their respective functions, calculation engine 110 and correction implementation engine 112 may access a data repository, e.g., a memory accessible to system 100 that can be used to store and retrieve data.

In the example of FIG. 1, system 100 includes a media sheet driver 102 for driving a media sheet. As used herein a "media sheet driver" refers generally to any combination of hardware and/or software to direct a media sheet along a media path. In an example, the driver may include rotatable rollers, wherein the rollers are caused to rotate by a drive mechanism. In examples the drive mechanism for the media sheet driver may include one or all of a set of gears, a set of pulleys, and/or a transmission. As used herein a "media sheet" refers generally to a print substrate that is in a sheet, piece, or page form, such that each media sheet is a distinct object that can be moved independently relative to other media sheets. A "media sheet" is to be distinguished as from a web media, wherein a continuous web of media is fed from a feeding roller, through a print engine, and then collected at a collection roller.

As used herein a "media path" refers generally to a bridge or any other element that is to guide a media sheet from a first location to a second location. In a particular example, the media path may be a media path within a printer. In a particular example, the media path may be a bridge between a first print location that is a media pickup component (sometimes referred to as "a picker") and a second printer location that is a print engine or print engine component downstream of the media pickup component. The print engine component that is downstream of the media pickup component may be a print bar in an example of inkjet printing. The print engine component that is downstream of the media pickup component may be an impression drum in an example of LEP printing.

Continuing with the example of FIG. 1, media sheet driver 102 of system 100 may include a set of rollers. In examples, media sheet driver 102 includes a set of rollers that are arranged upon a common axis. In a particular example, media sheet driver 102 includes a set of rollers that are arranged upon a common axis, wherein a media sheet driver is to cause each of the rollers of the set to be driven at a same speed.

System 100 for media sheet skew correction includes a blocker element 108 situated orthogonal to the media path. Blocker element 108 is to mechanically cause a rotation of a media sheet as the media sheet is driven into the blocker element by media sheet driver 102. In examples, blocker element 108 has a width greater than the width of the media sheet that is to impact the blocker element. As used herein, "width" of a blocker element refers generally to a measurement of the blocker element from a first edge to a second edge, wherein the first and second edges are edges of the blocker element orthogonal to the media path. In examples, blocker element 108 may be an element that includes a metal, nonmetal, plastic, and is to have a hardness that enables blocker element 108 to cause a media sheet to rotate when the media sheet is driven, along a media path, into blocker element 108 by media sheet driver 102. In examples, blocker element 108 is movable into and out of a blocking position within the media path. In various examples the movement of blocker element 108 in and out of a blocking position along the media path may be or include any of a vertical movement, a horizontal movement, a swinging movement, and/or a rotating movement.

Continuing with the example of FIG. 1, system 100 for media sheet skew correction includes first sensor 104 and second sensor 106. First sensor 104 and second sensor 106 are both situated upstream of blacker element 108 along the media path. First sensor 104 is to detect a first portion of a leading edge of a media sheet as the media sheet is transported by media sheet driver 102 along the media path. Second sensor 106 is to detect a second portion of the leading edge of the media sheet as the media sheet is transported along the media path. In examples, first sensor 104 and second sensor 106 sensors are optical sensors. In other examples, first sensor 104 and/or second sensor 106 may a sensor other than an optical sensor, e.g., a mechanical sensor, an electrical tactile sensor, or an infrared sensor.

Calculation engine 110 represents generally a combination of hardware and programming to a calculation engine to calculate a driver correction specification. The driver correction specification is for causing skew correction of the media sheet as the media sheet impacts the blocker element. Calculation engine 110 calculates the driver correction specification based upon a time differential between first sensor 104 detecting the first portion of the media sheet and second sensor 106 detecting the second portion of the media sheet.

Continuing with the example of FIG. 1, in examples, calculation engine 110 is to calculate the driver correction specification based upon a dimension of the media sheet. In a particular example, calculation engine 110 is to calculate the driver correction specification based upon width of a rectangular media sheet. As used herein, "width" of a rectangular media sheet refers generally to a measurement of the media from a first edge to a second edge, wherein the first and second edges are edges of the media sheet orthogonal to the leading edge of the media sheet. In an example, the width of the media accessed by calculation engine 110 may be a width that was measured by system 100 at another point in the media path, e.g., at the media sheet pickup component. In another example, the width of the media accessed by calculation engine 110 may be a width that was provided to system 100 in numerical form by user input via a user interface. In yet another example, the width of the media accessed by calculation engine 110 may be a width that is associated with a user selection of a media sheet size among a set of available media sheet sizes (e.g., user selection of media size "a×b" among alternatives "a×b", "c×d", and "e×f" at an operator screen at the printer or a computing device in network connection with the printer).

In examples, calculation engine 110 is to calculate a driver correction specification that includes an amount of time and a speed that the driver is to be engaged to cause a leading corner of the leading edge to impact the blocker element and advance a lagging corner of the leading edge to a position such that the leading edge is horizontal with the blocker element. As described previously herein, in certain examples media sheet driver 102 may include a roller or a set of rollers. And as described previously herein, the set of rollers may be a set of rollers that are arranged upon a common axis and to be driven at a common speed. In these examples, the calculated correction specification may include a time and a speed that the roller or the set of rollers are to be engaged to cause a leading corner of the leading edge to impact the blocker element and advance a lagging corner of the leading edge to a position such that the leading edge is horizontal with the blocker element. In other examples, calculation engine 110 may calculate a correction specification that includes a same number of turns that each of the set of rollers is to be engaged.

Continuing with the example of FIG. 1, in certain examples, calculation engine 110 may calculate a correction specification that includes a change in speed of the roller of the set of rollers of the driver. In a particular example, the change in speed may be a change from a first speed to a second speed that is approximately 25% of the first speed. In another particular example, the change in speed may be a change from a first speed that is approximately 2.5 m/s to a second speed that is approximately 0.6 m/s.

Correction implementation engine 112 represents generally a combination of hardware and programming to cause media sheet driver 102 to operate according to the calculated driver correction specification. As a result of such operation, media sheet driver 102 will be engaged for a duration and speed to cause the media sheet to the impact blocker element 108 such that a lagging corner of the leading edge is precisely advanced to a position such that the leading edge is horizontal with blocker element 108.

Figure 2:
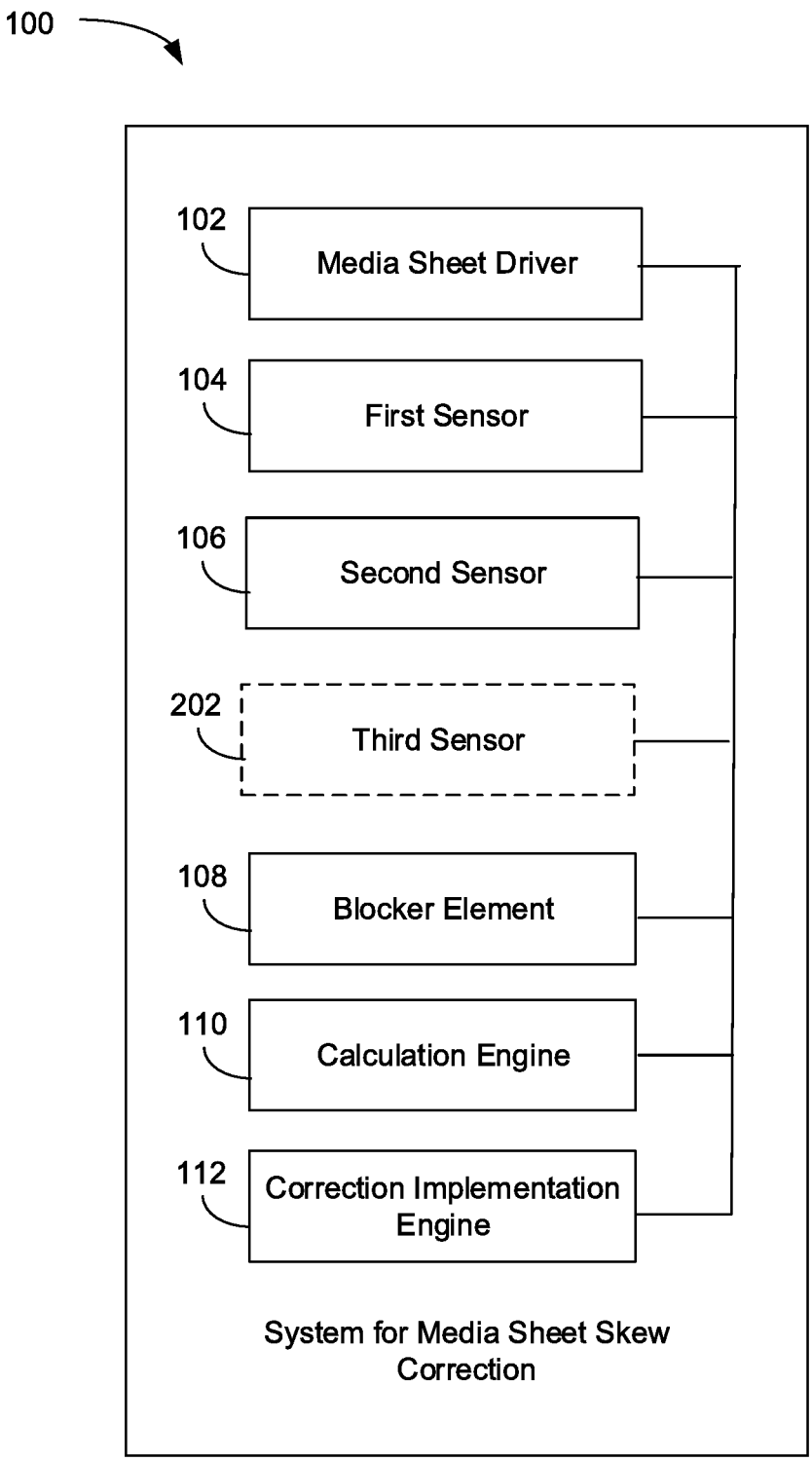
FIG. 2 illustrates an example of a system for media sheet skew correction, the printer system including first, second, and third sensors.

FIG. 2 illustrates another example of system 100 for media sheet skew correction. As in FIG. 1, system 100 includes a media sheet driver 102, a first sensor 104, a second sensor 106, a blocker element 108, a calculation engine 110, and a correction implementation engine 112. System 100 of FIG. 2 additionally includes a third sensor 202. Third sensor 202 is to detect a media sheet as the media sheet is being transported at a first speed. Further, third sensor 202 is to trigger correction implementation engine 112 to implement the driver correction specification such that the media sheet is transported at a second speed that is less than the first speed. In examples, the media sheet may be transported at a second speed that is approximately 25% of the first speed. In a particular example, the first speed may be approximately 2.5 m/s and the second speed approximately 0.6 m/s.

In the foregoing discussion of FIGS. 1 and 2, engines 110 and 112 were described as combinations of hardware and programming. Engines 110 and 112 may be implemented in a number of fashions. Looking at FIG. 3 the programming may be processor executable instructions stored on a tangible memory resource 330 and the hardware may include a processing resource 340 for executing those instructions. Thus, memory resource 330 can be said to store program instructions that when executed by processing resource 340 implement system 100 of FIGS. 1-5.

Memory resource 330 represents generally any number of memory components capable of storing instructions that can be executed by processing resource 340. Memory resource 330 is non-transitory in the sense that it does not encompass a transitory signal but instead is made up of a memory component or memory components to store the relevant instructions. Memory resource 330 may be implemented in a single device or distributed across devices. Likewise, processing resource 340 represents any number of processors capable of executing instructions stored by memory resource 330. Processing resource 340 may be integrated in a single device or distributed across devices. Further, memory resource 330 may be fully or partially integrated in the same device as processing resource 340, or it may be separate but accessible to that device and processing resource 340.

In one example, the program instructions can be part of an installation package that when installed can be executed by processing resource 340 to implement system 100. In this case, memory resource 330 may be a portable medium such as a CD, DVD, or flash drive or a memory maintained by a server from which the installation package can be downloaded and installed. In another example, the program instructions may be part of an application or applications already installed. Here, memory resource 330 can include integrated memory such as a hard drive, solid state drive, or the like.

Figure 3:
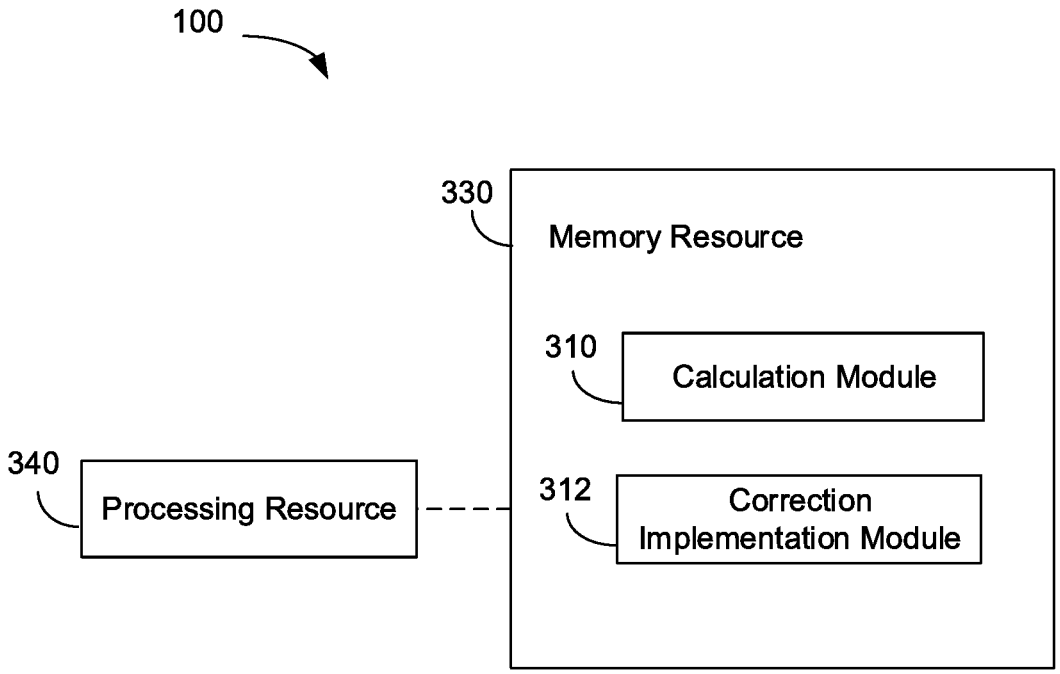
FIG. 3 is a block diagram depicting a memory resource and a processing resource to implement an example of a method for media sheet skew correction.

In FIG. 3, the executable program instructions stored in memory resource 330 are depicted as calculation module 310 and correction implementation module 312. Calculation module 310 represents program instructions that when executed by processing resource 340 may perform any of the functionalities described above in relation to calculation engine 110 of FIGS. 1 and 2. Correction implementation module 312 represents program instructions that when executed by processing resource 340 may perform any of the functionalities described above in relation to correction implementation engine 112 of FIGS. 1 and 2.

FIGS. 4A, 4B, 4C, 4D, and 4E illustrate an example of a system for media sheet skew correction 100. Beginning at FIG. 4A, in this example, system 100 includes a set of rollers 102 connected along a common axis 402 for transporting a media sheet 404 along a media path 406. System 100 includes a first optical sensor 104 for detecting a first portion of a leading edge 408 of media sheet 404 as media sheet 404 is transported along media path 406 by roller set 102. System 100 includes a second sensor 106 to detect a second portion of leading edge 408 of media sheet 404 as media sheet 404 is transported along media path 406. System 100 includes a blocker element 108 situated orthogonal to media path 406 and downstream of first sensor 104 and second sensor 106. In certain examples, blocker element 108 may be movable into and out of the blocking position shown in FIGS. 4A-4E. In this example blocker element 108 a width 480 that is greater than the width 470 (FIG. C) of media 404. At FIG. 4A, media sheet 404 is being transported by roller set 102 along media path 406 towards blocker element 108, but has not yet been detected by first optical sensor 104 or second optical sensor 106.

Moving to FIG. 48, media sheet 404 is transported by roller set 102 along media path 406 towards blocker element 108. In this view, first optical sensor 104 has detected a first leading portion 430 of leading edge 408, but second optical sensor 106 has not yet detected media sheet 404.

Figure 4A:
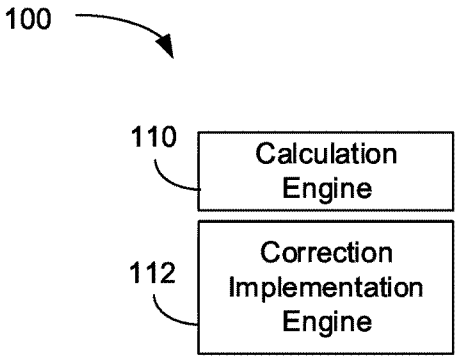
FIG. 4 illustrates an example of a system for media sheet skew correction.
Figure 4A:
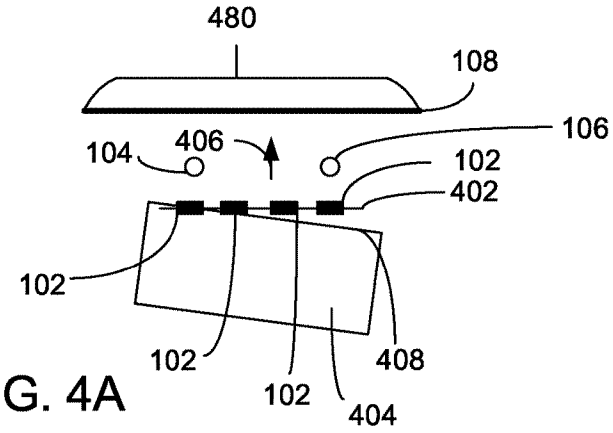
Figure 4B:
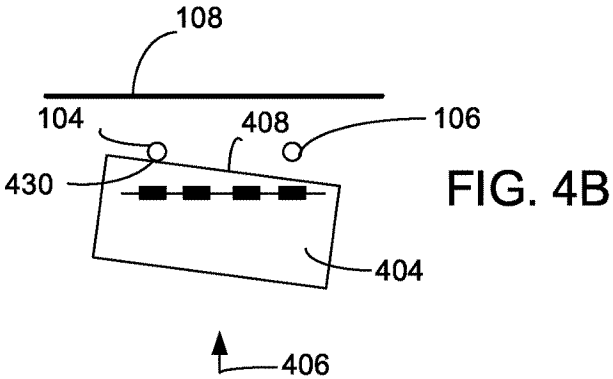
Figure 4C:
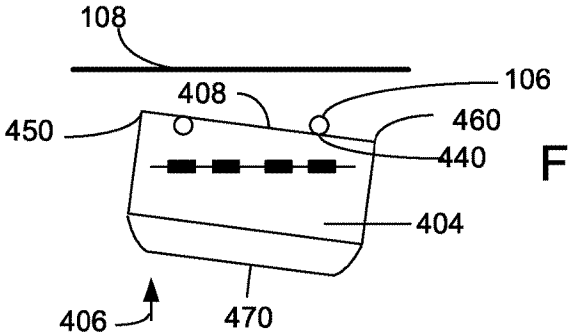

Moving to FIG. 4C, in this view media sheet 404 continues to be transported by roller set 102 along media path 406 towards blocker element 108. In this view second optical sensor 106 has detected a second leading portion 440 of leading edge 408. Calculation engine 110 is to calculate, based upon a time differential between first optical sensor 104 detection of first portion 430 (FIG. 48) and second optical sensor 106 detection of second portion 440, a driver correction specification. The driver correction specification is for causing skew correction of media sheet 404 as media sheet impacts blocker element 108. In certain examples, calculation engine 110 is to calculate the driver correction specification in consideration of the width 470 of the media sheet 404. In certain examples, calculated driver correction specification includes an amount of time and a speed that the set of rollers 102 is to be engaged to cause a leading corner 450 of leading edge 408 to impact blacker element 108 and advance a lagging corner 460 of leading edge 408 to a position such that leading edge 408 is horizontal with blocker element 108. In certain examples, the calculated driver correction specification is to cause each roller of the plurality of rollers to be driven at a same speed. In certain examples, the calculated driver correction specification includes a change in speed of the rollers of the driver to precisely accomplish the skew correction. In examples, the change of speed is a change from a first speed to a second speed that is approximately 25% of the first speed. In a particular example, the first speed may be approximately 2.5 m/s and the second speed may be approximately 0.6 m/s. In other examples, the calculated driver correction specification may include a number of turns that set of rollers are to be engaged.

Figure 4D:
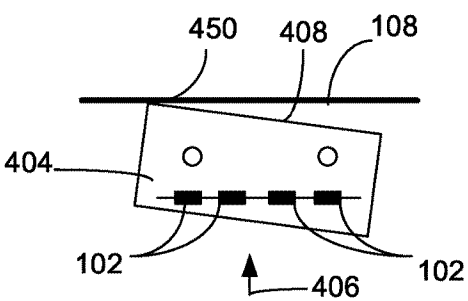
Figure 4E:
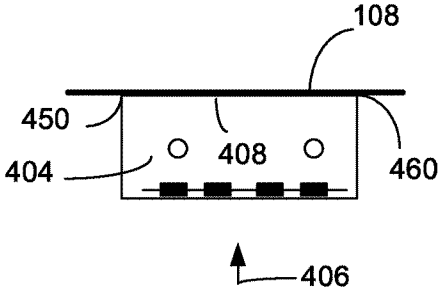

Moving to FIGS. 4D and 4E in view of FIG. 4A, correction implementation engine 112 is to cause the set of rollers to operate according to the driver correction specification that was calculated by calculation engine 110. At FIG. 4D, the set of rollers 102 has precisely advanced media sheet 404, according to the calculated driver correction specification, such that leading corner 450 of leading edge 408 impacts blocker element 108. At FIG. 4E, the set of rollers 102 has continued to precisely advanced media sheet 404, according to the calculated driver correction specification, such that a lagging corner 460 of leading edge 408 is advanced to a position such that leading edge 408 is horizontal with blocker element 108. In certain examples lagging corner 460 is to impact blocker element 108. In this manner the skew of media sheet 404 has been corrected without buckling, bending, or otherwise deforming or damaging media sheet 404.

In a particular example, calculation engine 110 may, based on a time differential between first optical sensor 104 detection of first portion 430 (FIG. 4B) and second optical sensor 106 detection of second portion 440 (FIG. 45), and based up on a width 470 (FIG. 4C) of the sheet media 404, calculate a driver correction specification utilizing a formula as follows:

$$\text{Skew_Sheet} = |S3f(\text{time}) - S3r(\text{time})| \times \text{sheet speed} \times \text{sheet width}/(\text{distance between } S3f \text{ and } S3r) \qquad \text{Formula:}$$

Example of use for formula:

S3*f*(time)=400 ms

S3*r*(time)=399 ms distance between S3*f* and S3*r*=400 mm

Sheet width=750 mm

Sheet speed=2.5 m/s=2.5 mm/ms

Result:

Skew_Sheet=1400 [ms]−399 [ms]|×2.5 [mm/ms]×750 [mm]/400 [mm]

Skew+Sheet=4.6875 mm

In this particular example, 4.6875 mm is the amount of overfeed that is needed for deskew of media 404. Correction implementation engine 112 is to receive this calculated information and causes the driver rollers to turn at a same speed to achieve the desired movement. In this example, the media sheet leading corner 450 (FIG. 4D) will hit blocker element 108. Lagging corner 460 (FIG. 4C) of leading edge 408 (FIG. 4C) will move additional 4.6875 mm until deskew occurs. The median point of leading edge 408 (FIG. 4C) will move 4.6875/2 mm until stopped by blocker element 108.

Figure 5A:
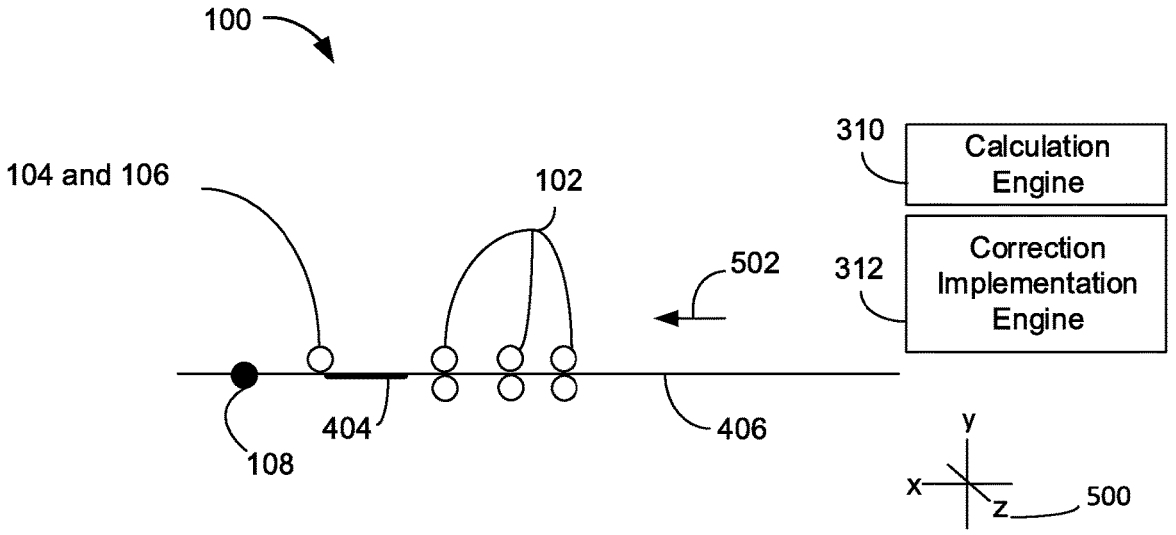

FIGS. 5A. 5B, 6A, 6B, 7A, 7B, and 7C illustrate cross section examples of a system for media sheet skew correction. For each of FIGS. 5A. 5B, 6A, 6B, 7A, 7B, and 7C, a driver 102 is to transport a media sheet 404 along a media path 406 in a transport direction 502. In examples, media path 406 may be a path along a belt (e.g., a transport belt), chute, a lane defined by rails, a drum, or any other physical structure. In other examples, media path 406 may not be evidenced by a particular structure. In the examples of FIGS. 5A. 5B, 6A, 6B, 7A, 7B, and 7C, driver 102 includes a set of rollers to contact a top surface of media sheet 404 with bottom rollers contacting a bottom surface of media sheet 404 to provide resistance. In other examples, driver 102 may include driving rollers at the bottom surface of media sheet 404 and not at the top surface. In other examples, driver 102 may include driving rollers both the top and the bottom surfaces of media sheet 404.

A first sensor 104 is to detect a first portion 430 (FIG. 4B) of a leading edge 408 (FIG. 4B) of media sheet 404 as media sheet 404 is transported along media path 406. A second sensor 106 to detect a second portion 440 (FIG. 4C) of the leading edge 408 (FIG. 4C) of media sheet 404 as media sheet 404 is transported along media path 406. In each of the examples FIGS. 5A. 5B, 6A, 6B, 7A, 7B, and 7C, first and second sensors 104 106 are situated parallel to one another relative to the z axis 500 and are illustrated with a hashed single oval labeled "104 and 106". In certain examples, first sensor 104 may be the sensor that is visible in FIG. 5A, with second sensor 106 being obscured in the drawing. In certain examples, second sensor 106 may be the sensor that is visible in FIG. 5A, with first sensor 104 being obscured in the FIGS. 5A. 5B, 6A, 6B, 7A, 7B, and 7C illustrations. In each of the examples FIGS. 5A. 5B, 6A, 6B, 7A, 7B, and 7C, a blocker element 108 is situated orthogonal to media path 406 and downstream of the first and second sensors 104 106.

In each of the examples FIGS. 5A. 5B, 6A, 6B, 7A, 7B, and 7C, a calculation engine 310 is to calculate, based upon a time differential between first sensor 104 detection of the first portion 430 (FIG. 4B) of the leading edge 408 (FIG. 4B) and second sensor 106 detection of the second portion of the leading edge 408 (FIG. 4C), and based upon a width 470 (FIG. 4C) of media sheet 404, a driver correction specification. The driver correction specification, when implemented is to cause skew correction of media sheet 404 as media sheet 404 impacts blocker element 108.

In each of the examples FIGS. 5A. 5B, 6A, 6B, 7A, 7B, and 7C, correction implementation engine 112 is to cause the driver 102 to operate according to the calculated correction specification and thereby correct the skewed condition of media sheet 404.

Figure 5B:
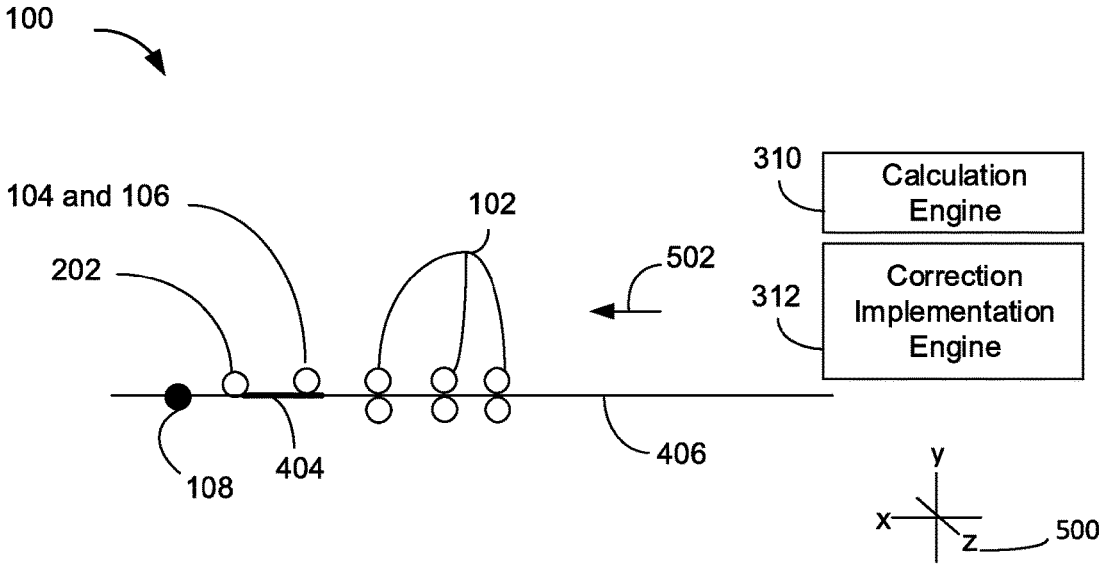

Moving to FIG. 5B, in this example system 100 for media sheet skew correction includes a third sensor 202. Third sensor 202 is to detect media sheet 404 as media sheet 404 is caused by driver 102 to be transported at a first speed. Third sensor 202 is to trigger correction implementation engine 312 to implement the calculated driver correction specification such that media sheet 404 is caused to be transported at a second speed that is less than the first speed.

Figure 6A:
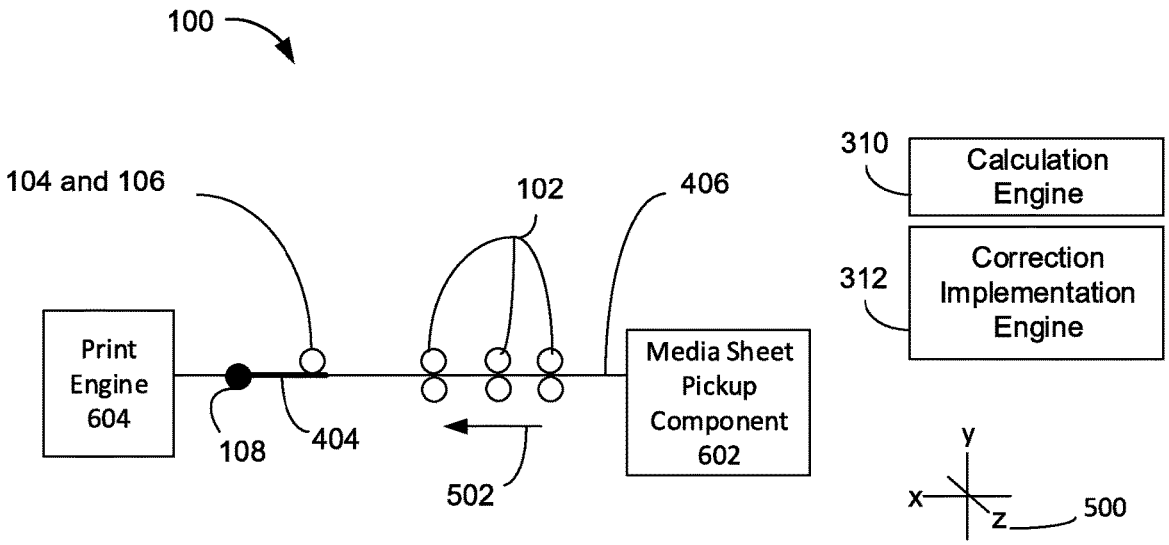

Moving to FIG. 6A, in this example system 100 for media sheet skew correction includes a media sheet pickup component 602. As used herein, a "media sheet pickup component" refers generally to any combination of hardware and/or software that enables a printer to retrieve a media sheet 404 from a stack or other aggregation of media sheets (e.g., a stack of media sheets in a tray). In this example, system 100 includes a print engine 604 to utilize printing method (e.g., a digital printing method [e.g., inkjet printing, dry toner printing, or LEP printing] or an analog printing method [e.g., flexography, letterpress, offset rotogravure, or screen printing] to print an image upon media sheet 404. In the example of FIG. 5C, media path 406 serves a bridge for transport of media sheet 404 between media sheet pickup component 602 and print engine 604.

Figure 6B:
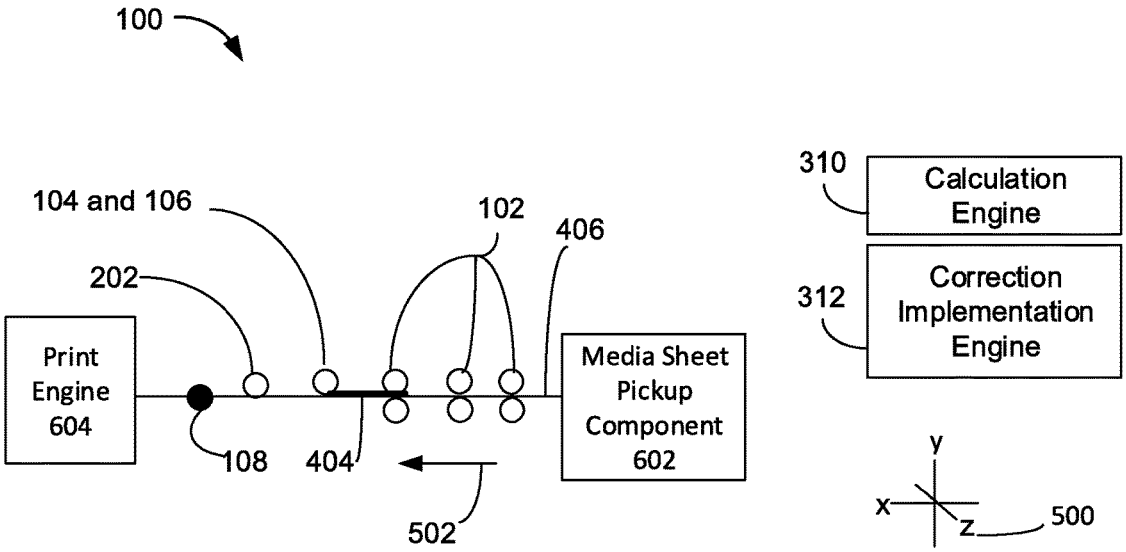

Moving to FIG. 6B, as with FIG. 6A in this example of system 100 for media sheet skew correction media path 406 serves a bridge for transport of media sheet 404 between media sheet pickup component 602 and print engine 604. In the example of FIG. 5B a third sensor 202 is to detect media sheet 404 as media sheet 404 is being transported at a first speed. Third sensor 202 is to trigger correction implementation engine 112 to implement the calculated driver correction specification such that media sheet 404 is transported along media path 406 towards blocker element 108 at a second speed that is less than the first speed.

Figure 7A:
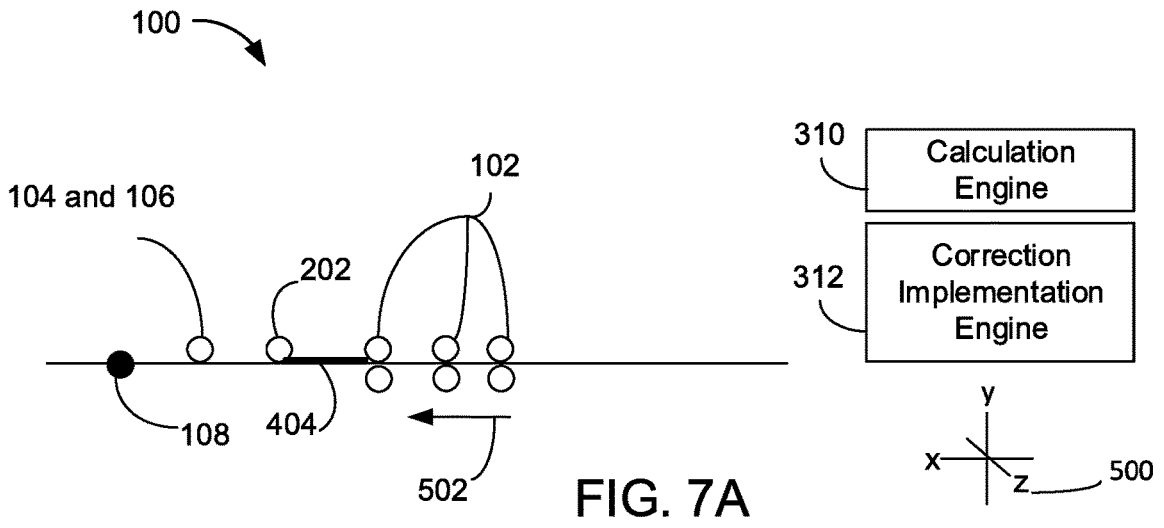
Figure 7B:
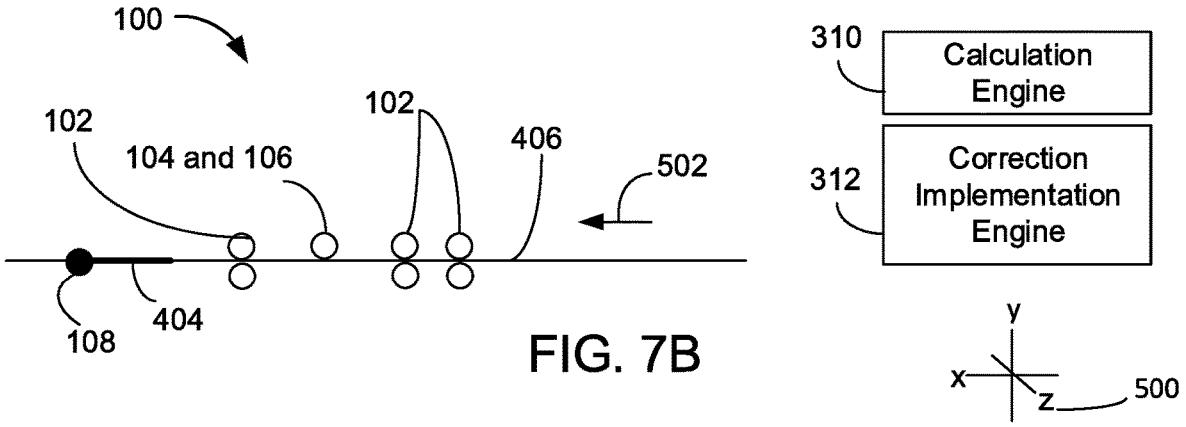
Figure 7C:
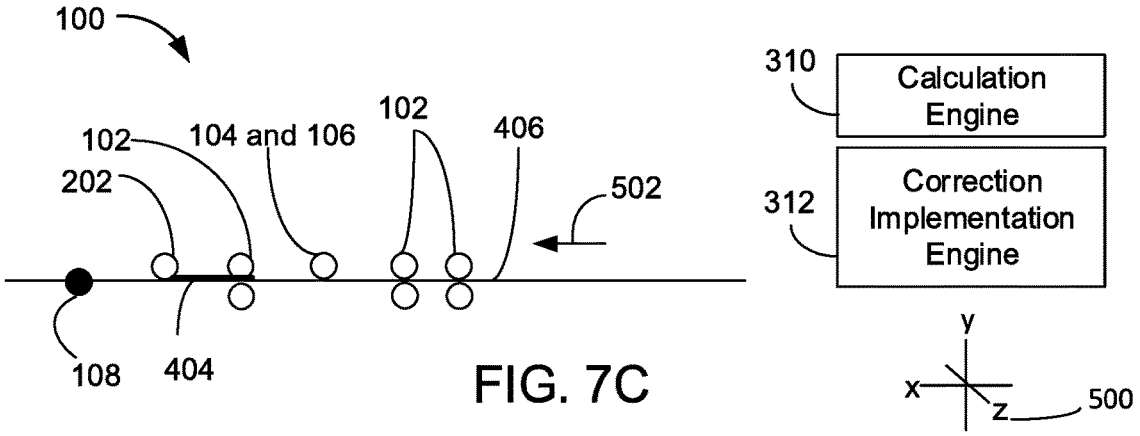

FIGS. 7A, 78, and 7C illustrate that in various examples elements of driver 102, first and second sensors 104 106, third sensor 202, and blocker element 108 may be situated in differing positions relative to one another along media path 406. Beginning at FIG. 7A, system 100 includes a driver 102 including three driving rollers at the top side of media sheet 404, all of which rollers are upstream (relative to transport direction 502) of first and second sensors 104 106, third sensor 202, and blacker element 108. In this example, third sensor 202 is downstream of driver 202 and upstream of first and second sensors 104 106 and blocker element. In this example, first and second sensors 104 106 are downstream of third sensor 202 and upstream of blocker element 108.

Moving to FIG. 7B, system 100 includes a driver 102 including three driving rollers at the top side of media 404, two of which driving rollers are upstream of first and second sensors 104 106 and one of which is downstream of first and second sensors 104 106. Blocker element 108 is downstream of all the rollers of driver 102 and downstream of first and second sensors 104 106.

Moving to FIG. 7C, system 100 includes a driver 102 including three driving rollers at the top side of media 404, two of which driving rollers are upstream of first and second sensors 104 106 and one of which is downstream of first and second sensors 104 106. In this example, a third sensor 202 is downstream of all of the rollers of driver 202 and downstream of first and second sensors 104 106, and upstream of blocker element 108. Blocker element 108 is downstream of all the rollers of driver 102, first and second sensors 104 106, and third sensor 202.

FIG. 8 is a schematic diagram showing a cross section of an example LEP printer 800 implementing the system 100 for media sheet skew correction, according to an example of the principles described herein. In an example, an LEP printer 800 may include a photoconductive element 802, a charging element 804, an imaging unit 806, an intermediate transfer member blanket 808, an impression cylinder 810, developer assemblies 812, a first cylindrical drum 840, a second cylindrical drum 840, According to the example of FIG. 8, a pattern of electrostatic charge is formed on a photoconductive element 802 by rotating a clean, bare segment of the photoconductive element 804 under a charging element 804. The photoconductive element 804 in this example is cylindrical in shape, e.g. is attached to a first cylindrical drum 840, and rotates in a direction of arrow 820. In other examples, a photoconductive element may planar or part of a belt-driven system.

Charging element 804 may include a charging device, such as a charge roller, corona wire, scorotron, or any other charging device. A uniform static charge is deposited on the photoconductive element 802 by the charging element 804. As the photoconductive element 802 continues to rotate, it passes an imaging unit 806 where one or more laser beams dissipate localized charge in selected portions of the photoconductive element 802 to leave an invisible electrostatic charge pattern ("latent image") that corresponds to the image to be printed. In some examples, the charging element 804 applies a negative charge to the surface of the photoconductive element 802. In other implementations, the charge is a positive charge. The imaging unit 806 then selectively discharges portions of the photoconductive element 802, resulting in local neutralized regions on the photoconductive element 802.

Continuing with the example of FIG. 8, developer assemblies 812 are disposed adjacent to the photoconductive element 802 and may correspond to various print fluid colors such as cyan, magenta, yellow, black, and the like. There may be one developer assembly 812 for each print fluid color. In other examples, e.g., black and white printing, a single developer assembly 812 may be included in LEP printer 800. During printing, the appropriate developer assembly 812 is engaged with the photoconductive element 802. The engaged developer assembly 812 presents a uniform film of print fluid to the photoconductive element 802. The print fluid contains electrically-charged pigment particles which are attracted to the opposing charges on the image areas of the photoconductive element 802. As a result, the photoconductive element 802 has a developed image on its surface, i.e. a pattern of print fluid corresponding with the electrostatic charge pattern (also sometimes referred to as a "separation").

The print fluid is transferred from the photoconductive element 802 to intermediate transfer member blanket 808. The blanket may be in the form of a blanket attached to a rotatable second cylindrical drum 860. In other examples, the blanket may be in the form of a belt or other transfer system. In this particular example, the photoconductive element 802 and blanket 808 are on drums 840 860 that rotate relative to one another, such that the color separations are transferred during the relative rotation. In the example of FIG. 8, the blanket 808 rotates in the direction of arrow 822. The transfer of a developed image from the photoconductive element 802 to the blanket 808 may be known as the "first transfer", which takes place at a point of engagement between the photoconductive element 802 and the blanket 808.

Once the layer of print fluid has been transferred to the blanket 808, it is next transferred to a print media. In this example, print media is a media sheet 404. This transfer from the blanket 808 to the print media may be deemed the "second transfer", which takes place at a point of engage between the blanket 808 and the print media. The impression cylinder 810 can both mechanically compress the print media into contact with the blanket 808 and also help feed the print media. In examples, the print media may be a conductive or a non-conductive print media, including, but not limited to, paper, cardboard, sheets of metal, metal-coated paper, or metal-coated cardboard. In examples, the print media with a printed image may be moved to a position to be scanned by an inline color measurement device 826, such as a spectrometer or densimeter, to generate optical density and/or background level data.

Controller 828 refers generally to any combination of hardware and software that is to control part, or all, of the LEP printer 800 print process. In examples, the controller 828 can control the voltage level applied by a voltage source, e.g., a power supply, to one or more of the developer assemblies 812, the blanket 808, a drying unit, and other components of LEP printer 800.

In this example controller 828 includes system 100 for media sheet skew correction that is discussed in detail with respect to FIGS. 1-4 herein. In particular, a driver 102 is to transport a media sheet 404 along a media path 406 in a transport direction 502. In this example, driver 102 includes a set of rollers be driven at a same speed and to drive media sheet 404 towards a moveable blocker element 108 and the blanket drum 860 and impression drum elements of LEP printer 800. First sensor 104 is to detect a first portion of a leading edge of media sheet 404 as media sheet 404 is transported along media path 406. A second sensor 106 to detect a second portion of the leading edge of media sheet 404 as media sheet 404 is transported along media path 406. Blocker element 108 is situated orthogonal to media path 406 and downstream of the first and second sensors 104 106. System for media sheet skew correction 100 is to calculate, based upon a time differential between first sensor 104 detection of the first portion of the leading edge and second sensor 106 detection of the second portion of the leading edge, and based upon a width of media sheet 404, a driver correction specification. System for media sheet skew correction 100 is to in turn cause driver 102 to operate according to the calculated correction specification and thereby correct the skewed condition of media sheet 404.

FIG. 9 is a flow diagram of implementation of a method for media sheet skew correction during printing. In discussing FIG. 9, reference may be made to the components depicted in FIGS. 1, 2 and 3. Such reference is made to provide contextual examples and not to limit the manner in which the method depicted by FIG. 9 may be implemented. A driver correction specification is calculated based upon a time differential between a first sensor detection of a first portion of a leading edge of a media sheet and second sensor detection of a second portion of the leading edge. The driver correction specification is for causing skew correction of the media sheet as the media sheet moves along a media path to impact a blocker element (block 902). Referring back to FIGS. 1, 2, and 3, calculation engine 110 (FIGS. 1 and 2) or calculation module 310 (FIG. 3), when executed by processing resource 340, may be responsible for implementing block 902.

The driver is caused to operate according to the calculated driver correction specification (block 904). Referring back to FIGS. 1. 2, and 3, correction implementation engine 112 (FIGS. 1 and 2) or correction implementation module 312 (FIG. 3), when executed by processing resource 340, may be responsible for implementing block 904.

FIGS. 1-9 aid in depicting the architecture, functionality, and operation of various examples. In particular, FIGS. 1-8 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 9 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

The invention claimed is:

1. A media sheet skew correction system, comprising:

a driver comprising a plurality of rollers situated upon a common shaft to transport a media sheet along a media path;

a first sensor to detect a first portion of a leading edge of the media sheet as the media sheet is transported along the media path;

a second sensor to detect a second portion of the leading edge of the media sheet as the media sheet is transported along the media path;

a blocker element situated orthogonal to the media path and downstream of the first sensor and the second sensor;

a calculation engine to calculate, based upon a time differential between first sensor detection of the first portion and second sensor detection of the second portion, a driver correction specification for causing skew correction of the media sheet as the media sheet impacts the blocker element; and a correction implementation engine to cause the driver to operate according to the calculated driver correction specification.

2. The media sheet skew correction system of claim 1, wherein the calculation engine is to calculate the driver correction specification based upon a dimension of the media sheet.

3. The media sheet skew correction system of claim 1, wherein the driver correction specification includes an amount of time and a speed that the driver is to be engaged to cause a leading corner of the leading edge to impact the blocker element and advance a lagging corner of the leading edge to a position such that the leading edge is horizontal with the blocker element.

4. The media sheet skew correction system of claim 1, wherein the correction specification includes a number of turns that the rollers are to be engaged.

5. The media sheet skew correction system of claim 1, wherein the correction implementation engine when implementing the driver correction specification drives each roller of the plurality of rollers at a same speed.

6. The media sheet skew correction system of claim 5, wherein the driver correction specification includes a change in speed of the rollers of the driver.

7. The media sheet skew correction system of claim 1, wherein the blocker element is movable into and out of a blocking position.

8. The media sheet skew correction system of claim 1, wherein the blocker element has a width greater than the width of the media.

9. The media sheet skew correction system of claim 1, wherein the media path is a bridge between a media sheet pickup component and a print engine.

10. The media sheet skew correction system of claim 1, wherein the first and second sensors are optical sensors.

11. The media sheet skew correction system of claim 1, further comprising a third sensor, the third sensor to detect the media sheet as the media sheet is being transported at a first speed, and to trigger correction implementation engine to implement the driver correction specification such that the media sheet is transported at a second speed that is less than the first speed.

12. The media sheet skew correction system of claim 11, wherein the second speed is approximately 25% of the first speed.

13. A method to correct media sheet skew, comprising utilizing a first sensor to detect a first portion of a leading edge of a media sheet as the media sheet is transported by a driver along a media path, the driver comprising a plurality of rollers situated upon a common shaft;

utilizing a second sensor to detect a second portion of the leading edge of the media sheet as the media sheet is transported by the driver along the media path;

calculating a correction specification for the driver, the correction specification for causing skew correction of the media sheet as the media sheet impacts a blocker element situated orthogonal to the media path and downstream of the first sensor and the second sensor, wherein the calculation is on consideration of a time differential between first sensor detection of the first portion and second sensor detection of the second portion and is in consideration of a width of the media sheet; and causing the driver to implement the calculated correction specification.

14. A printer system, comprising:

a media sheet pickup component;

a print engine, a media path to bridge between the media sheet pickup component and the print engine;

a driver including a plurality of rollers situated upon a common shaft to transport a media sheet along the media path;

a first sensor to detect a first portion of a leading edge of the media sheet as the media sheet is transported along the media path;

a second sensor to detect a second portion of the leading edge of the media sheet as the media sheet is transported along the media path;

a blocker element situated orthogonal to the media path and downstream of the first sensor and the second sensor;

a calculation engine to calculate a driver correction specification for causing skew correction of the media sheet as the media sheet impacts the blocker element, wherein the calculation is based upon a time differential between first sensor detection of the first portion and second sensor detection of the second portion, and the calculation is based upon a dimension of the media sheet; and a correction implementation engine to cause the driver to operate according to the calculated correction specification.

* * * * *